US011762313B2

(12) United States Patent
Nakamura

(10) Patent No.: US 11,762,313 B2
(45) Date of Patent: Sep. 19, 2023

(54) DEVELOPER STORAGE CONTAINER TO REDUCE THE NUMBER OF MOLDS AND IMAGE FORMING APPARATUS

(71) Applicant: KYOCERA Document Solutions Inc., Osaka (JP)

(72) Inventor: Yuri Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/890,161

(22) Filed: Aug. 17, 2022

(65) Prior Publication Data

US 2023/0074696 A1 Mar. 9, 2023

(30) Foreign Application Priority Data

Aug. 24, 2021 (JP) ..... 2021-136248

(51) Int. Cl.
*G03G 15/08* (2006.01)
*G03G 21/16* (2006.01)
*G03G 21/18* (2006.01)

(52) U.S. Cl.
CPC ..... *G03G 15/0886* (2013.01); *G03G 15/0863* (2013.01); *G03G 21/1676* (2013.01); *G03G 21/1896* (2013.01); *G03G 2215/0668* (2013.01); *G03G 2215/0692* (2013.01)

(58) Field of Classification Search
CPC ..... G03G 15/0863; G03G 15/0886; G03G 21/1676; G03G 21/1875; G03G 21/1896; G03G 2215/0668; G03G 2215/0692; G03G 2215/0695; G03G 2221/1892
See application file for complete search history.

(56) References Cited

U.S. PATENT DOCUMENTS 7,551,860 B2 * 6/2009 Kawai ..... G03G 21/1896 399/12
2013/0216243 A1 * 8/2013 Kouroku ..... G03G 15/0863 399/262
2013/0266346 A1 10/2013 Yoshii et al.

FOREIGN PATENT DOCUMENTS

JP 2013218039 A 10/2013

* cited by examiner

*Primary Examiner* — Sophia S Chen
(74) *Attorney, Agent, or Firm* — Alleman Hall Creasman & Tuttle LLP

(57) ABSTRACT

A developer storage container includes a container body and a shape forming member. The developer storage container is attached to and detached from any one of three or more mounting portions provided to an image forming apparatus forming an image using a developer. The container body has a side wall portion formed in a mounting direction to the image forming apparatus. The shape forming member is attached to the side wall portion in a mode to correspond to any one of three mounting portions, forming a first non-compatible shape corresponding to this mounting portion.

6 Claims, 13 Drawing Sheets

DEVELOPER STORAGE CONTAINER TO REDUCE THE NUMBER OF MOLDS AND IMAGE FORMING APPARATUS

INCORPORATION BY REFERENCE

This application is based upon and claims the benefit of priority from the corresponding Japanese Patent Application No. 2021-136248 filed on Aug. 24, 2021, the entire contents of which are incorporated herein by reference.

BACKGROUND

The present disclosure relates to a developer storage container and an image forming apparatus to/from which the developer storage container is attached/detached.

An image forming apparatus forming images using multiple types of developer such as multi color toners is known. This type of image forming apparatus is provided with mounting portions each mounted with a developer storage container, e.g., toner container to store corresponding developer.

In addition, another image forming apparatus is known that includes mounting portions each having a corresponding incompatible shape to prevent mounting of a developer storage container not having a shape corresponding to the incompatible shape.

SUMMARY

A developer storage container according to one aspect of the present disclosure includes a container body and a shape forming member. The developer storage container is attached to and detached from any one of three or more mounting portions provided to an image forming apparatus that forms images using developer. The container body has a side wall portion formed along a mounting direction to the image forming apparatus. The shape forming member is mounted to the side wall portion with a mounting mode corresponding to any one of the mounting portions to thereby forming a first non-compatible shape corresponding to the mounting portion.

An image forming apparatus according to another aspect of the present disclosure includes the developer storage container and the three or more mounting portions. The three or more mounting portions have respective second non-compatible shapes each having a different shape. The first non-compatible shape corresponds in shape to any one of the second non-compatible shapes.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

An embodiment of the present disclosure will be described below with reference to the drawings. Note that the embodiment described below is merely a specified example of the present disclosure and does not intend to limit the technical scope of the present disclosure.

[Configuration of Image Forming Apparatus 100]

Figure 1:
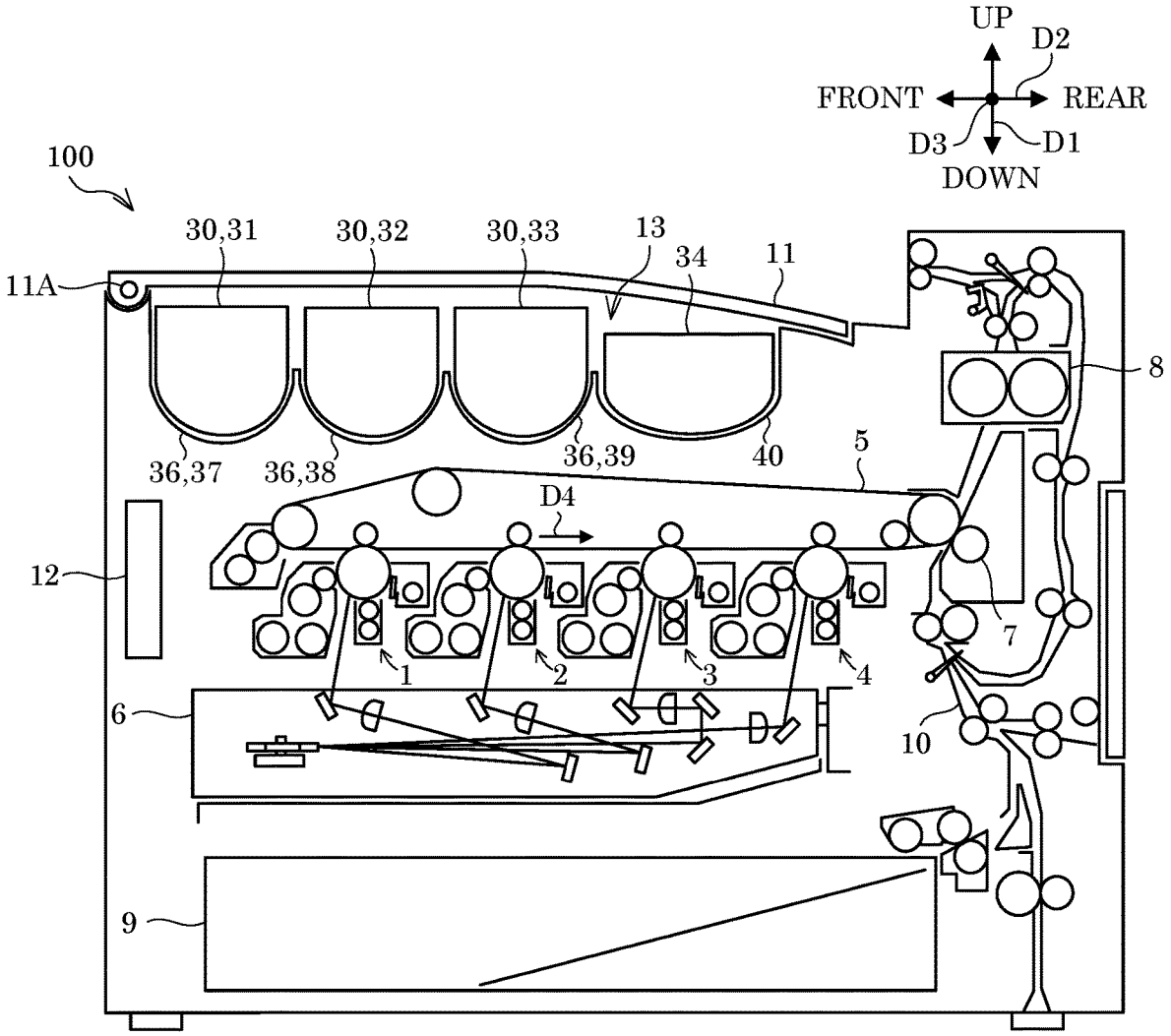
FIG. 1 is a diagram showing the configuration of an image forming apparatus according to an embodiment of the present disclosure.
Figure 2:
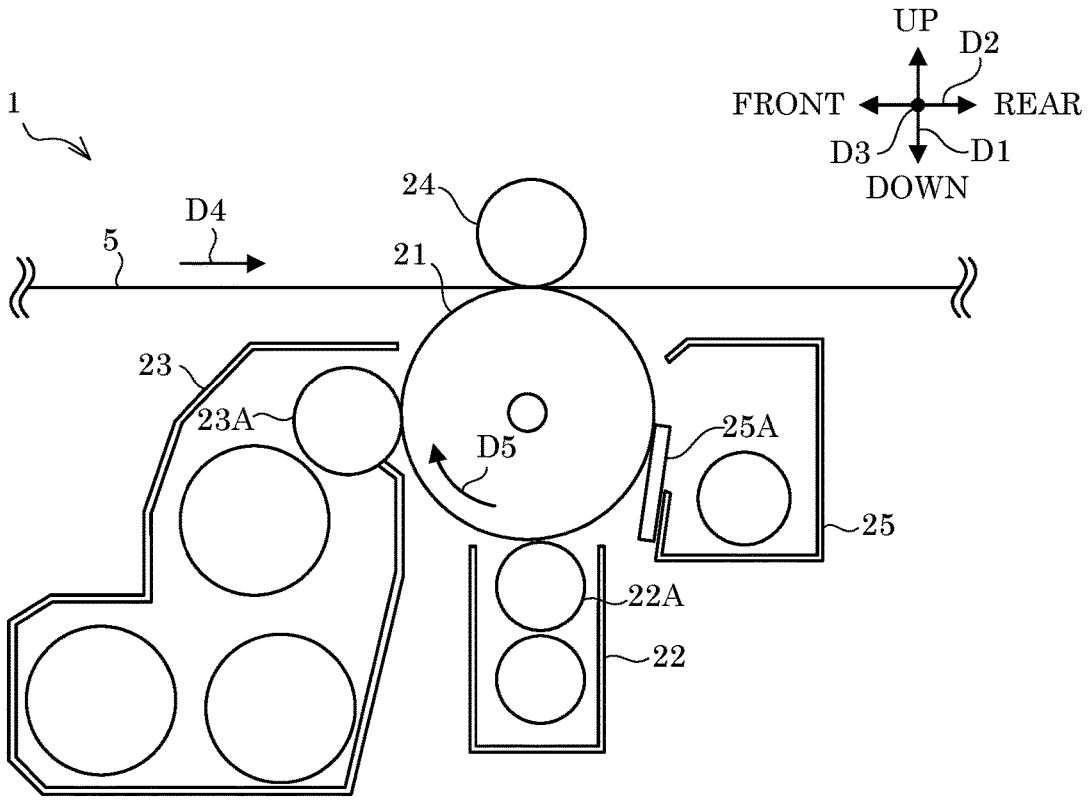
FIG. 2 is a diagram showing the configuration of an image forming portion of the image forming apparatus according to the embodiment of the present disclosure.

First, the configuration of an image forming apparatus 100 according to the embodiment of the present disclosure will be described below with reference to FIG. 1 and FIG. 2. FIG. 1 is a cross sectional view showing the configuration of the image forming apparatus 100. FIG. 2 is a cross sectional view showing the configuration of an image forming portion 1 of the image forming apparatus 100.

Note that the upright direction of the image forming apparatus 100 in a usable installed state (the state shown in FIG. 1) is defined as a vertical direction D1, for convenience of description. In addition, the front-rear direction D2 of the image forming apparatus 100 is defined on the basis of the left side surface thereof designated as a front surface (fore surface). Furthermore, the left-right direction D3 of the image forming apparatus 100 is defined on the basis of the front surface of the installed image forming apparatus 100.

The image forming apparatus 100 is a color printer that forms a color image or monochrome image on a sheet-shape paper using toner (example of the developer in the present disclosure). The present disclosure may be applied to facsimile apparatuses, copiers, multifunction peripherals, and the like.

As shown in FIG. 1, the image forming apparatus 100 includes a plurality of image forming portions 1, 2, 3, 4, an intermediate transfer belt 5, an optical scanning device 6, a secondary transfer roller 7, a fixing device 8, a sheet feed cassette 9, a conveying path 10, a cover member 11, a controller 12 and a toner supplying portion 13.

The image forming apparatus 100 is so-called a tandem type. The image forming portions 1, 2, 3, 4 are arranged side by side along the belt rotation direction D4 (see FIG. 1) of the intermediate belt 5. The image forming portion 1 forms a Y (yellow) toner image, while the image forming portion 2 forms a M (magenta) toner image, the image forming portion 3 forms a C (cyan) toner image and the image forming portion 4 forms a K (black) toner image.

As shown in FIG. 2, the image forming portion 1 includes a photoconductor drum 21. The image forming portion 1 also includes a charging device 22, a developing device 23, a primary transfer roller 24 and a cleaning device 25 so as to correspond to the photoconductor drum 21. The image forming portions 2, 3, 4 each have the same configuration as the image forming portion 1. The configuration of the image forming portion 1 only will be described below.

The photoconductor drum 21 is an image-carrying member carrying an electrostatic latent image and a toner image. The photoconductor drum 21 can rotate in the rotational direction D5 (see FIG. 2).

The charging device 22 has a charging roller 22A. With electric power supplied from a power source, not shown, the charging device 22 charges the photoconductor drum 21 to a predetermined potential using the charging roller 22A. The optical scanning device 6 applies a laser beam on the basis of image data to the surface of the photoconductor drum 21 charged by the charging device 22. With this, an electrostatic latent image corresponding to the image data is formed on the surface of the photoconductor drum 21.

The developing device 23 has a developing roller 23A. The developing device 23 develops the electrostatic latent image on the photoconductor drum 21 using the developing roller 23A. An external material such as a lubricant or abrasive is used with the toner in the development of the electrostatic latent image by the developing device 23.

The primary transfer roller 24 transfers the toner image developed on the photoconductor drum 21 by the imaging device 23 to the intermediate transfer belt 5.

The cleaning device 25 is provided downstream of the primary transfer roller 24 in the rotational direction D5 of the photoconductor drum 21 and cleans the surface of the photoconductor drum 21. The cleaning device 25 includes a cleaning member 25A such as a cleaning roller or cleaning blade.

The intermediate transfer roller 5 is a to-be transferred member on which toner images of the photoconductor drums 21 each having a corresponding color are sequentially laid on and transferred while running above the photoconductor drums 21.

The optical scanning device 6 irradiates a laser beam based on the image data to each of the photoconductor drums 21 provided in the respective image forming portions 1, 2, 3, 4.

The secondary transfer roller 7 transfers the toner image on the intermediate transfer belt 5 to the sheet conveyed from the sheet-feed cassette 9 through the conveying path 10.

The fixing device 8 fixes the toner image transferred to the sheet from the secondary transfer roller 7 on the sheet. The sheet having the toner image fixed by the fixing device 8 is discharged on the upper surface of the cover member 11 provided on the image forming apparatus 100.

The sheet-feed cassette 9 stores sheets on which images are to be formed.

The conveying path 10 is a moving passage of the sheets travelling from the sheet-feed cassette 9 to the upper surface of the cover member 11. The conveying path 10 is formed inside the housing of the image forming apparatus 100.

The cover member 11 covers the toner supplying portion 13. The cover member 11 is provided above the toner supplying portion 13. The cover member 11 also serves as a tray to receive sheets having images formed by the image forming portion 3. The cover member 11 is supported at a front end thereof by a rotation shaft 11A extending in the left-right direction D3 so that it can rotate. This allows a user of the image forming apparatus 100 to open and close the cover member 11. The cover member 11 is opened when the toner containers 31-34 (see FIG. 1) attached to the mounting portions 37-40 (see FIG. 1) are to be replaced.

The controller 12 collectively controls the image forming apparatus 100. The controller 12 includes a CPU, ROM and RAM. The CPU is a processor to execute various calculation processing. The ROM is a non-volatile storage device storing in advance information such as a control program to instruct the CPU to execute various processing. The RAM is a volatile or non-volatile storage device used as a temporally storage memory (operation zone) of various processing that the CPU executes. The controller 12 executes various control programs stored in the ROM by the CPU in advance. With these, the controller 12 collectively controls the image forming apparatus 100.

[Configuration of Toner Supplying Portion 13]

Figure 3:
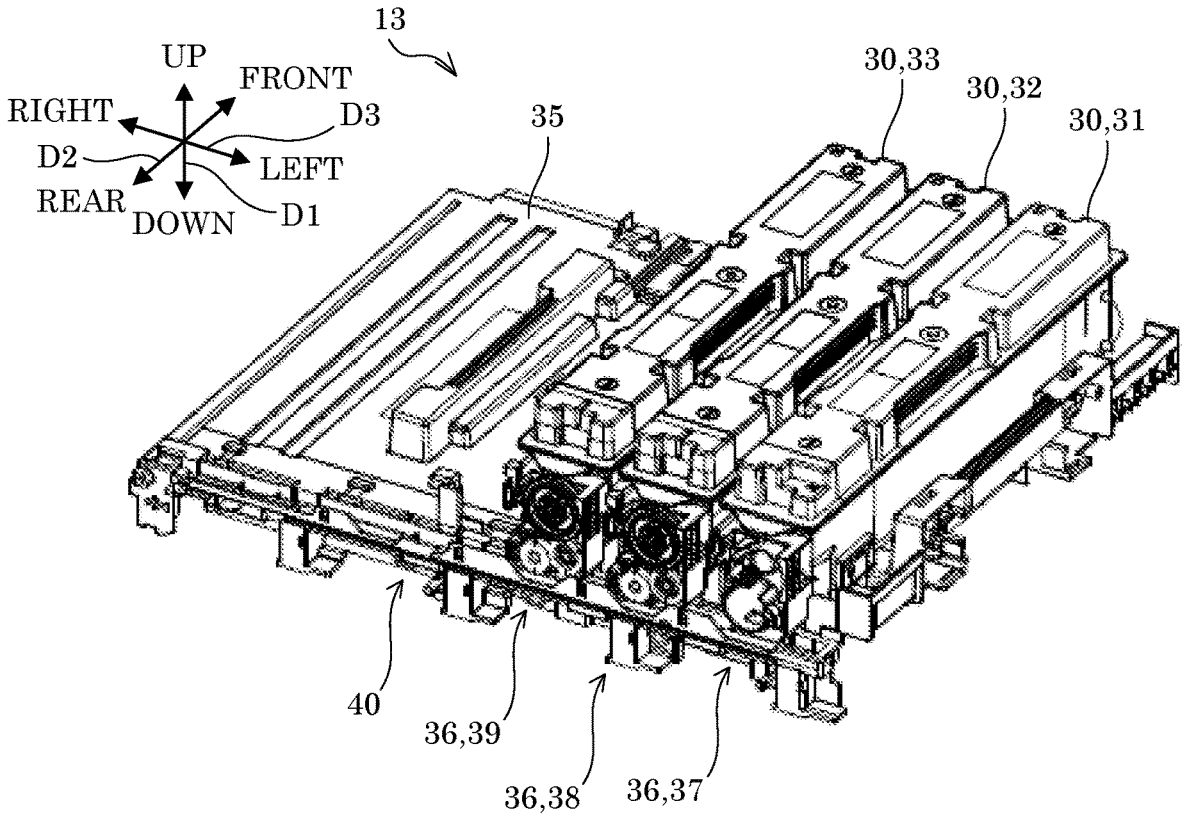
FIG. 3 is a diagram showing the configuration of a toner supplying portion of the image forming apparatus according to the embodiment of the present disclosure.

Next, the configuration of the toner supplying portion 13 will be described below with reference to FIG. 1 and FIG. 3. FIG. 3 is a perspective view showing the configuration of the toner supplying portion 13. Note that FIG. 3 shows a toner container 34 (see FIG. 1) removed from the mounting portion 40.

The toner supplying portion 13 supplies toner to each of the developing devices 23 of the image forming portions 1, 2, 3, 4.

As shown in FIG. 1 and FIG. 3, the toner supplying portion 13 includes the toner containers 31-34 and a container supporting portion 35.

The toner container 31 contains Y (yellow) toner. Similarly, the toner container 32 contains M (magenta) toner. The toner container 33 contains C (cyan) toner. The toner container 34 contains K (black) toner. As shown in FIG. 1, the toner container 34 is longer than the toner containers 31-33 in the front-rear direction D2. The toner containers 31-33 have a common configuration except color of contained toner and mounting mode of a shape forming member 56. Below, the toner containers 31-33 may be collectively referred to as a toner container 30.

The container supporting portion 35 supports the toner containers 31-34. As shown in FIG. 3, the container supporting portion 35 includes mounting portions 37-40. The mounting portion 37 receives the toner container 31 in a detachable manner (see FIG. 1). Similarly, the mounting portion 38 receives the toner container 32 detachably (see FIG. 1). The mounting portion 39 receives the toner container 33 detachably (see FIG. 1). The mounting portion 40 receives the toner container 34 in a detachable manner (see FIG. 1). Below, the mounting portions 37-39 may be collectively referred to as a mounting portion 36. The toner container 30 is an example of the developer storage container in the present disclosure.

Meanwhile, an image forming apparatus is known as a related art of the present disclosure. This image forming apparatus includes mounting portions 36 each having a different non-compatible shape so as to prevent attachment of a toner container 30 not having a shape to correspond to the non-compatible shape.

Unfortunately, in the image forming apparatus of the related art, a non-compatible shape in the side of the toner container 30 is integrally formed with a container body 51 (see FIG. 4) of the toner container 30 or in a member to be attached to the container body 51. Thus, molds each for the corresponding one of the non-compatible shapes in the sides of the toner containers 30 have to be prepared.

In contrast, in the image forming apparatus 100 according to the present disclosure, the number of molds to be used for manufacturing toner containers 30 having non-compatible shapes can be reduced, as will be described below.

Specifically, the image forming apparatus 100 is provided with different second non-compatible shapes 36A (see FIG. 10) each for a corresponding mounting portion 36. In addition, in the image forming apparatus 100, a first non-compatible shape 30A (see FIG. 4) corresponding to the second non-compatible shape 36A is formed by a shape forming member 56A to be attached to the toner container 30 in a mounting mode corresponding to the second non-compatible shape 36A.

[Configuration of Toner Container 30]

Figure 4:
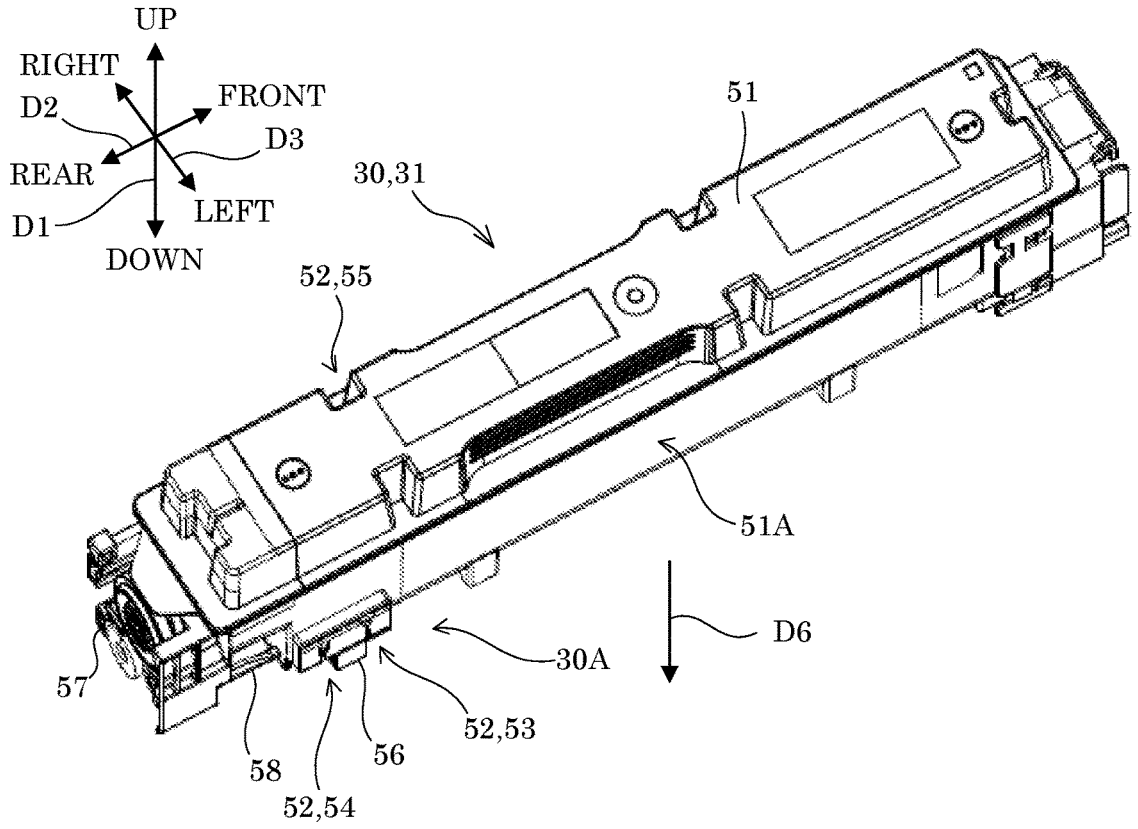
FIG. 4 is a diagram showing the configuration of a toner container of the image forming apparatus according to the embodiment of the present disclosure.
Figure 5:
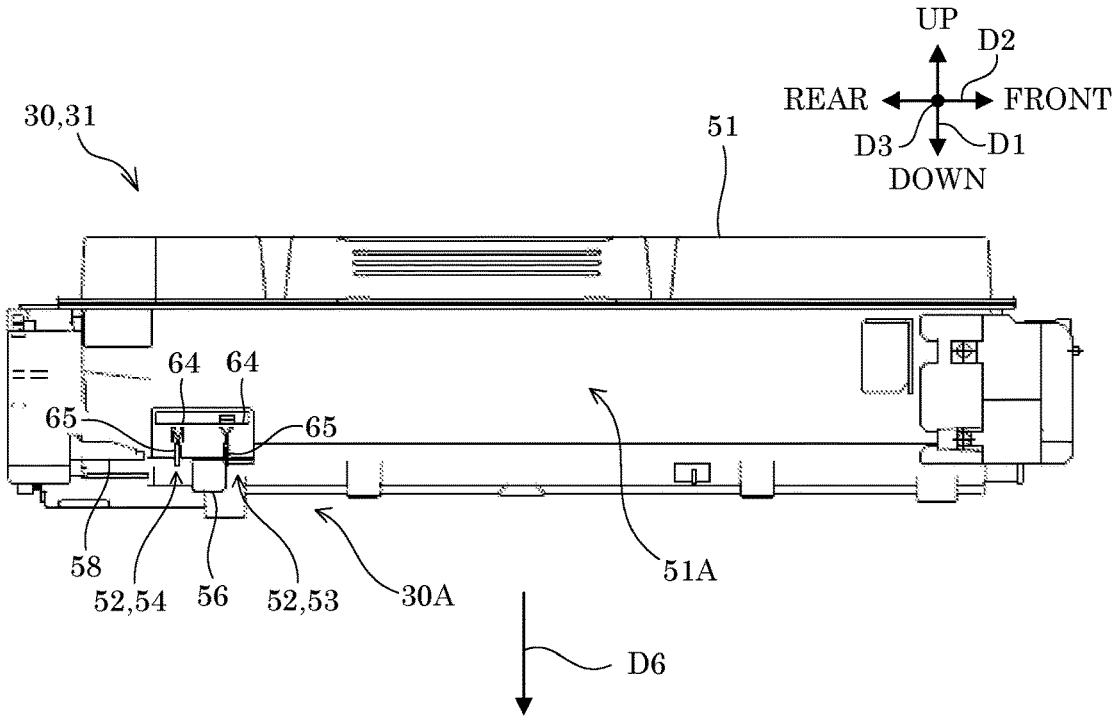
FIG. 5 is a diagram showing the configuration of the toner container of the image forming apparatus according to the embodiment of the present disclosure.
Figure 6:
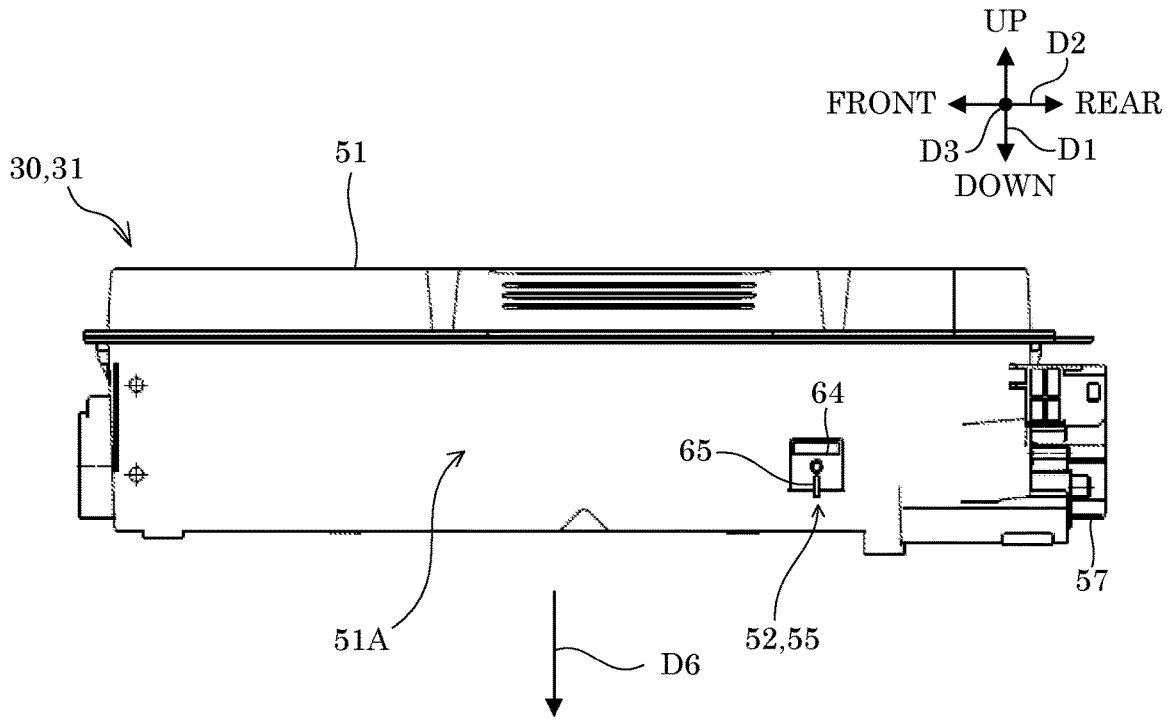
FIG. 6 is a diagram showing the configuration of the toner container of the image forming apparatus according to the embodiment of the present disclosure.
Figure 7:
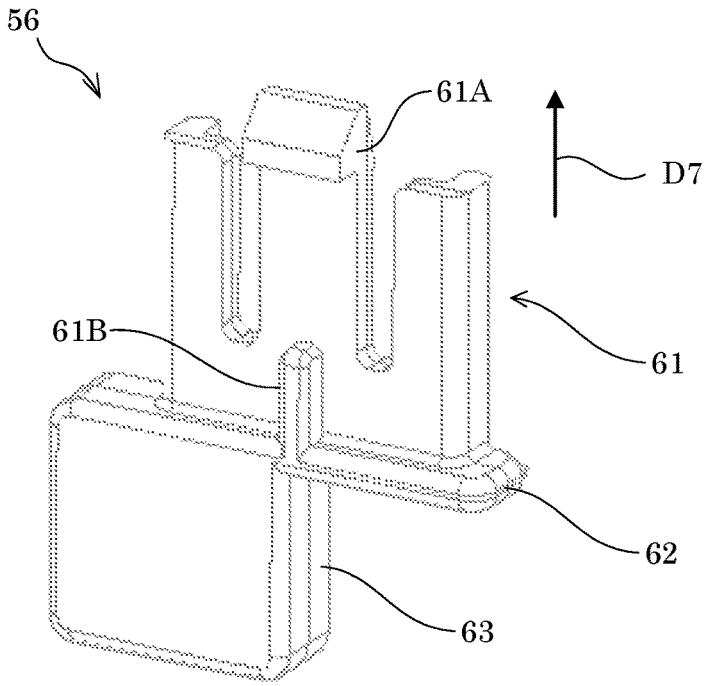
FIG. 7 is a diagram showing the configuration of a shape forming member of the image forming apparatus according to the embodiment of the present disclosure.
Figure 8:
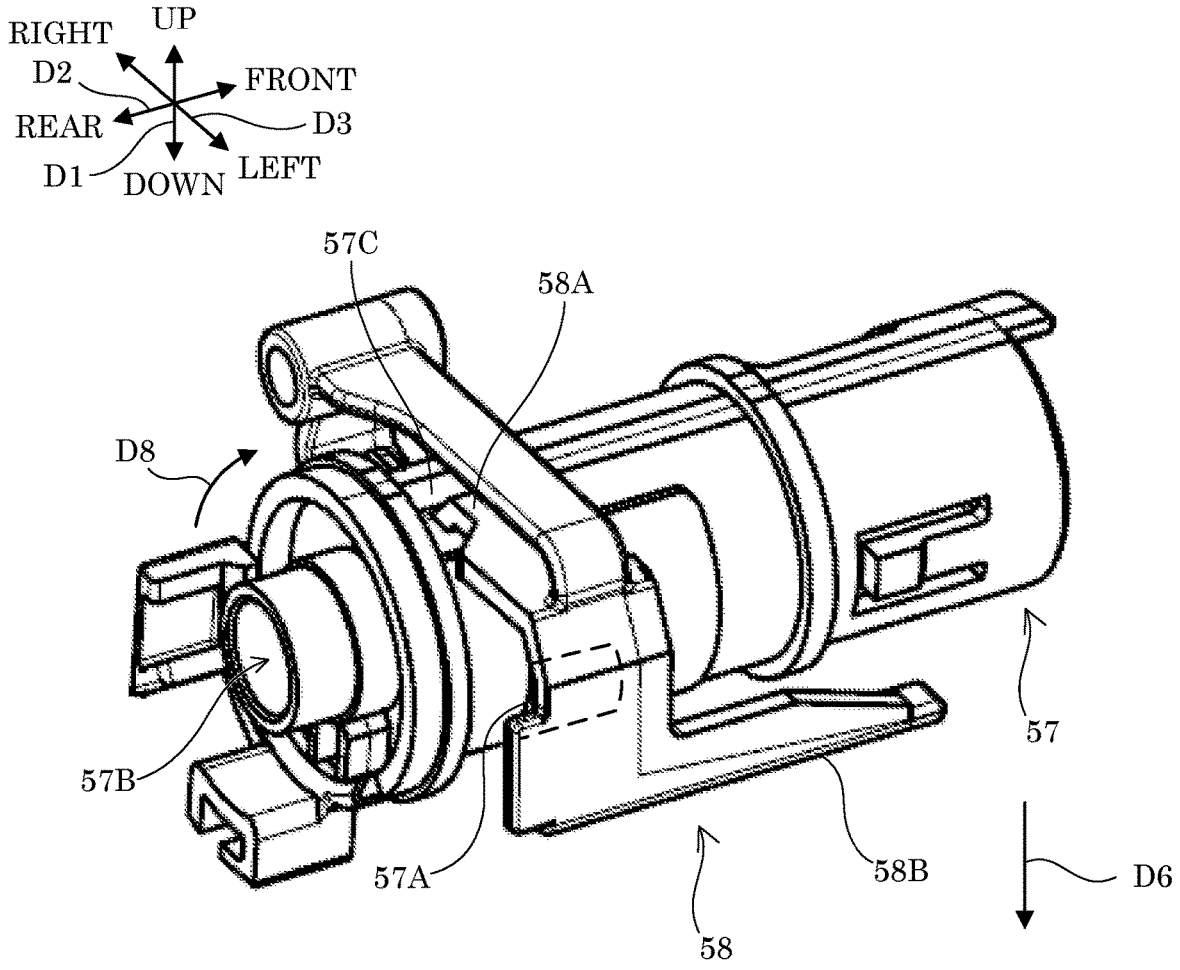
FIG. 8 is a diagram showing a shutter member of the image forming apparatus according to the embodiment of the present disclosure.
Figure 9:
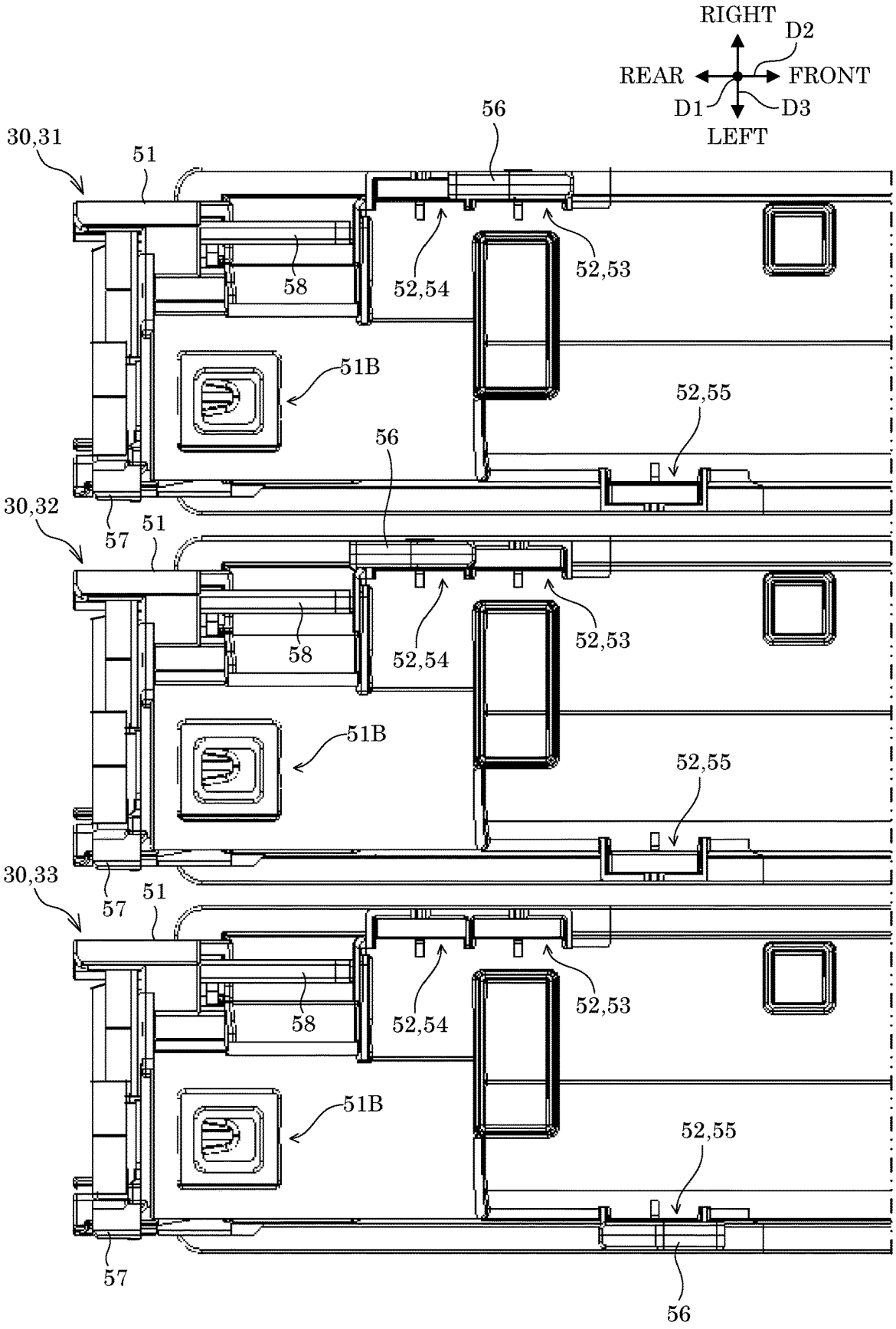
FIG. 9 is a diagram showing the configuration of the toner containers of the image forming apparatus according to the embodiment of the present disclosure.

The configuration of a toner container 30 having a first non-compatible shape 30A will be described below with reference to FIG. 4 to FIG. 9. FIG. 4 is a perspective view showing the configuration of a toner container 31. FIG. 5 is a left-side view showing the configuration of the toner container 31. FIG. 6 is a right-side view showing the configuration of the toner container 31. FIG. 7 is a perspective view showing the configuration of a shape forming member 56. FIG. 8 is a perspective view showing the configuration of a shutter member 57. FIG. 9 is a bottom view showing the configurations of rear ends of three toner containers 30. Note that an opening 57A in FIG. 8 is illustrated with a broken line.

As shown in FIG. 4 to FIG. 6, the toner container 30 includes a container body 51, a plurality of openings 52, a shape forming member 56, a shutter member 57 and a lever member 58.

The container body 51 contains toner. As shown in FIG. 4, the container body 51 has a long square columnar shape in a direction orthogonal to a mounting direction D6 along which the toner container 30 is mounted to the image forming apparatus 100. The mounting direction D6 is a vertically downward direction. The container body 51 has inside thereof a toner containing space for containing the toner.

The container body 51 has a side wall portion 51A formed along the mounting direction D6 along which it is mounted to the image forming apparatus 100. The container body 51 further includes a bottom surface facing downstream of the mounting direction D6 and an upper surface facing upstream of the mounting direction D6. The side wall portion 51A forms a front surface, a rear surface, a right-side surface and a left-side surface of the container body 51 of long square columnar shape. The toner containing space is a space surrounded by the side wall portion 51A, the bottom surface and the upper surface.

The toner contained in the container body 51 is conveyed to the rear end of the container body 51 along a longitudinal direction. Specifically, the container body 51 includes inside thereof a conveying screw that conveys the toner contained in the container body 51 toward the rear end of the container body 51. The conveying screw includes a long rotational shaft in the longitudinal direction (front-rear direction) of the container body 51. The rotational shaft is rotatably supported by the side wall portion 51A of the container body 51. The conveying screw receives driving force of a motor provided to a body side of the image forming apparatus 100 via a power transmission mechanism. The conveying screw rotates by the driving force of the motor received via the power transmission mechanism. With this, the toner contained inside the container body 51 is conveyed toward the rear end of the container body 51.

As shown in FIG. 9, the container body 51 has at a rear end of the bottom surface thereof a discharging mouth 51B opening downward. Toner conveyed to the rear end of the container body 51 by the conveying screw is discharged outside the container body 51 through the discharging mouth 51B.

The plurality of openings 52 are arranged on the side wall portion 51A in the circumferential direction of the side wall portion 51A. The circumference direction is a direction that is orthogonal to the mounting direction D6 and runs along the outer surface of the side wall portion 51A. The number of openings 52 is the same as that of the mounting portions 36. That is, the toner container 30 has three openings 52.

Specifically, as shown in FIG. 5, an opening 53 among the three openings 52 is provided at a rear end of the left-side surface of the side wall portion 51A. Similarly, an opening 54 among the three openings 52 is provided near and behind the opening 53. Furthermore, as shown in FIG. 6, an opening 55 among the three openings 52 is provided at a rear end of the right-side surface of the side wall portion 51A.

The openings 52 project from the side wall portion 51A toward an outside of the container body 51, opening in the mounting direction D6 (see FIG. 9). This configuration can avoid provision of a receiving space inside the container body 51 unlike the configuration where an opening 52 is simply open to an outside, the receiving space receiving an inserting portion 61 (see FIG. 7) to be inserted into the opening 52. Accordingly, reduction of the amount of toner to be contained in the container body 51, due to provision of the receiving space, can be avoided.

Each opening 52 is a flat rectangular parallelepiped shape formed on the outer surface of the side wall portion 51A (see FIG. 4). Each opening 52 has a mouth at an outer side facing a downstream side in the mounting direction D6. Each opening 52 forms a receiving space receiving an inserting portion 61 (see FIG. 7) of the shape forming member 56 together with an outer surface of the side wall portion 51A.

The container body 51 including a plurality of openings 52 is made of resin material such as synthetic resin in an integral form. In the image forming apparatus 100, container bodies 51 having a common configuration are used for production of the toner containers 31-33. In other words, the container bodies 51 used for production of the toner containers 31-33 are molded with a single mold.

The shape forming member 56 attached to the side wall portion 51A in a mode to correspond to any one of a plurality of mounting portions 36 forms a first non-compatible shape 30A with respect to the mounting portion 36.

Specifically, as shown in FIG. 7, the shape forming member 56 has an inserting portion 61. The inserting portion 61 is inserted into the opening 52. The inserting portion 61 of the shape forming member 56 is inserted into any one of the openings 52. With this, part of the shape forming member 56 except the inserting portion 61 projects from the opening 52, forming a first non-compatible shape 30A. In other words, the shape forming member 56 inserted into any one of the openings 52 in the side wall portion 51A in such a manner that part thereof projects from the opening 52 forms a first non-compatible shape 30A.

For example, in the image forming apparatus 100, attachment of the shape forming member 56 to the opening 53 forms a first non-compatible shape 30A corresponding to the second non-compatible shape 36A (see FIG. 10) of the mounting portion 37. That is, in the toner container 31 to be attached to the mounting portion 37 (see FIG. 3), the shape forming member 56 is mounted to the opening 53 (see FIG. 9).

Similarly, in the image forming apparatus 100, attachment of the shape forming member 56 to the opening 54 forms a first non-compatible shape 30A corresponding to the second non-compatible shape 36A (see FIG. 10) of the mounting portion 38. That is, in the toner container 32 to be attached to the mounting portion 38 (see FIG. 3), the shape forming member 56 is mounted to the opening 54 (see FIG. 9).

Likewise, in the image forming apparatus 100, attachment of the shape forming member 56 to the opening 55 forms a first non-compatible shape 30A corresponding to the second non-compatible shape 36A (see FIG. 10) of the mounting portion 39. In other words, in the toner container 33 to be attached to the mounting portion 39 (see FIG. 3), the shape forming member 56 is mounted to the opening 55 (see FIG. 9).

As shown in FIG. 7, the inserting portion 61 has a great length in the inserting direction D7. The inserting portion 61 has a hook-shaped engaging portion 61A at a tip end thereof in the inserting direction D7. On the other hand, each opening 52 has a to-be-engaged portion 64 that can engage with the engaging portion 61A (see FIG. 5). For example, the to-be-engaged portion 64 is a window that is formed in an outer surface side of the opening 52 of rectangular parallelepiped shape and faces outside the container body 51. The engaging portion 61A engages with the to-be-engaged portion 64 by snap-fitting when the inserting portion 61 is inserted into the opening 52. This engagement prevents removal of the shape forming member 56 from the opening 52 after engagement.

As shown in FIG. 7, the inserting portion 61 has a project-line portion 61B formed in the inserting direction D7. On the other hand, each opening 52 has a guide groove 65 guiding the project-line portion 61B in the inserting direction D7 (see FIG. 5). The guide groove 65 is formed on the outer surface side of the opening 52 in the mounting direction D6. The project-line portion 61B guided by the guide groove 65 prevents movement of the shape forming member 56 attached to the opening 52 in a direction orthogonal to the extending direction of the guide groove 65.

As shown in FIG. 7, the shape forming member 56 has a supporting portion 62 and a protruding portion 63. The supporting portion 62 supports a rear end of the inserting portion 61 in the inserting direction D7 (see FIG. 7). For example, the supporting portion 62 is formed in a flat plate shape on a plane orthogonal to the inserting direction D7. The protruding portion 63 is provided to the supporting portion 62 at a distance from the inserting portion 61 in a direction orthogonal to the inserting direction D7 and projects to an upstream side of the inserting direction D7. The supporting portion 62 is formed into a substantially rectangular parallelepiped shape, for example. The protruding portion 63 protrudes from the opening 52 when the shape forming member 56 is attached to the opening 52.

The shape forming member 56 is made of resin material such as synthetic resin in an integral form. In the image forming apparatus 100, shape forming members 56 having a common configuration are used for production of the toner containers 31-33. In other words, the shape forming members 56 used for production of the toner containers 31-33 are molded with a single mold.

The shutter member 57 is provided so that it can open and close the discharging mouth 51B (see FIG. 9).

Specifically, as shown in FIG. 8, the shutter member 57 has a substantially cylindrical shape. The shutter member 57 is disposed inside the container body 51 so as to face against the discharging mouth 51B.

As shown in FIG. 8, the shutter member 57 has an opening 57A and a shaft hole 57B. The opening 57A is provided on the outer circumference of the shutter member 57 so as to face against the discharging mouth 51B. The opening 57A has a shape substantially same as the discharging mouth 51B. The shaft hole 57B is formed so that it can receive the rotational shaft of the conveying screw. The shutter member 57 is supported by the rotational shaft received by the shaft hole 57B so as to be able to rotate about the rotational shaft. Rotation of the shutter member 57 about the rotational shaft provides an open state where the opening 57A faces against the discharging mouth 51B to open the discharging mouth 51B and a closed state where the opening 57A does not face against the discharging mouth 51B to close the discharging mouth 51B. Note that FIG. 8 shows the closed state of the shutter member 57.

The shutter member 57 is urged by an urging member, not shown, from the closed state to the open state in the urging direction D8 (see FIG. 8). As shown in FIG. 8, the shutter member 57 has a projecting portion 57C projecting from the outer circumference thereof.

The lever member 58 restricts the shutter member 57, which receives the urging force of the urging member, form changing its status from the closed state to the open state. More specifically, the lever member 58 has an engaging portion 58A shown in FIG. 8. The engaging portion 58A contacts the projecting portion 57C to restrict the change of the shutter member 57 from the closed state to the open state.

The lever member 58 is provided so as to operate in a direction opposite the mounting direction D6. Operation of the lever member 58 in the opposite direction release the restriction of the change of the state of the shutter 57. More specifically, the lever member 58 has a to-be-contacted portion 58B shown in FIG. 8. The to-be-contacted portion 58B is formed integrally with the engaging portion 58A. The to-be-contacted portion 58B pushed up in the direction opposite the mounting direction D6 causes the engaging portion 58A to retract from the position where the engaging portion 58A contacts the projecting portion 57C. This releases the restriction of the change of the state of the shutter member 59 by the engaging portion 58A.

[Configuration of Mounting Portions 37-39]

Figure 10:
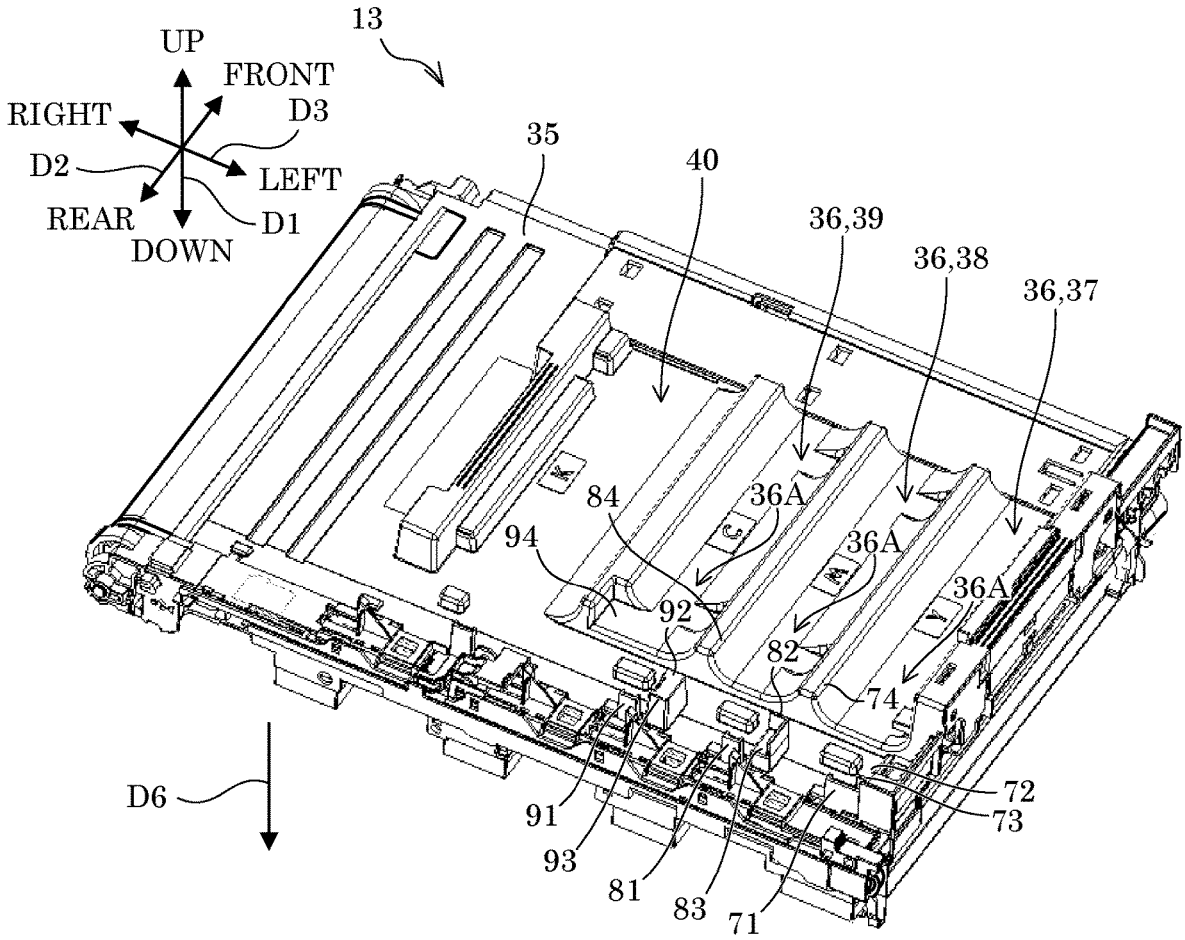
FIG. 10 is a diagram showing the configuration of mounting portions of the image forming apparatus according to the embodiment of the present disclosure.
Figure 11:
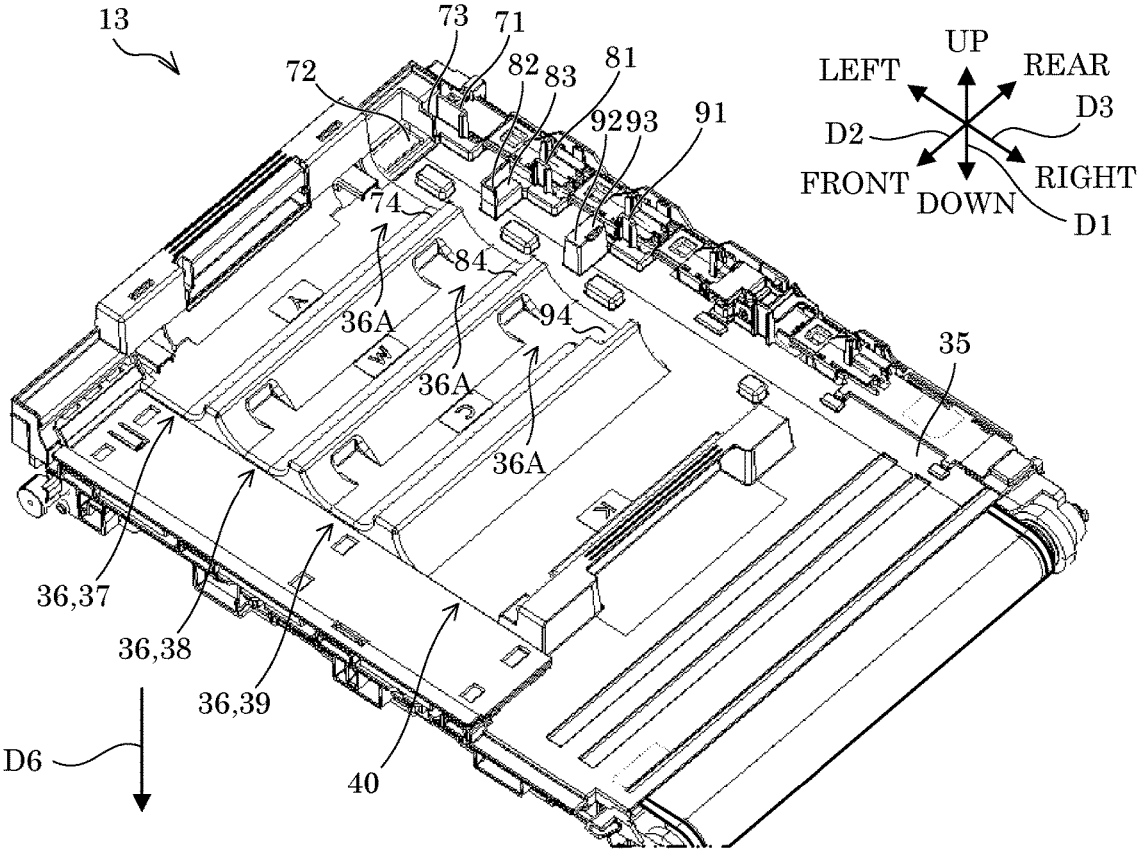
FIG. 11 is a diagram showing the configuration of the mounting portions of the image forming apparatus according to the embodiment of the present disclosure.
Figure 12:
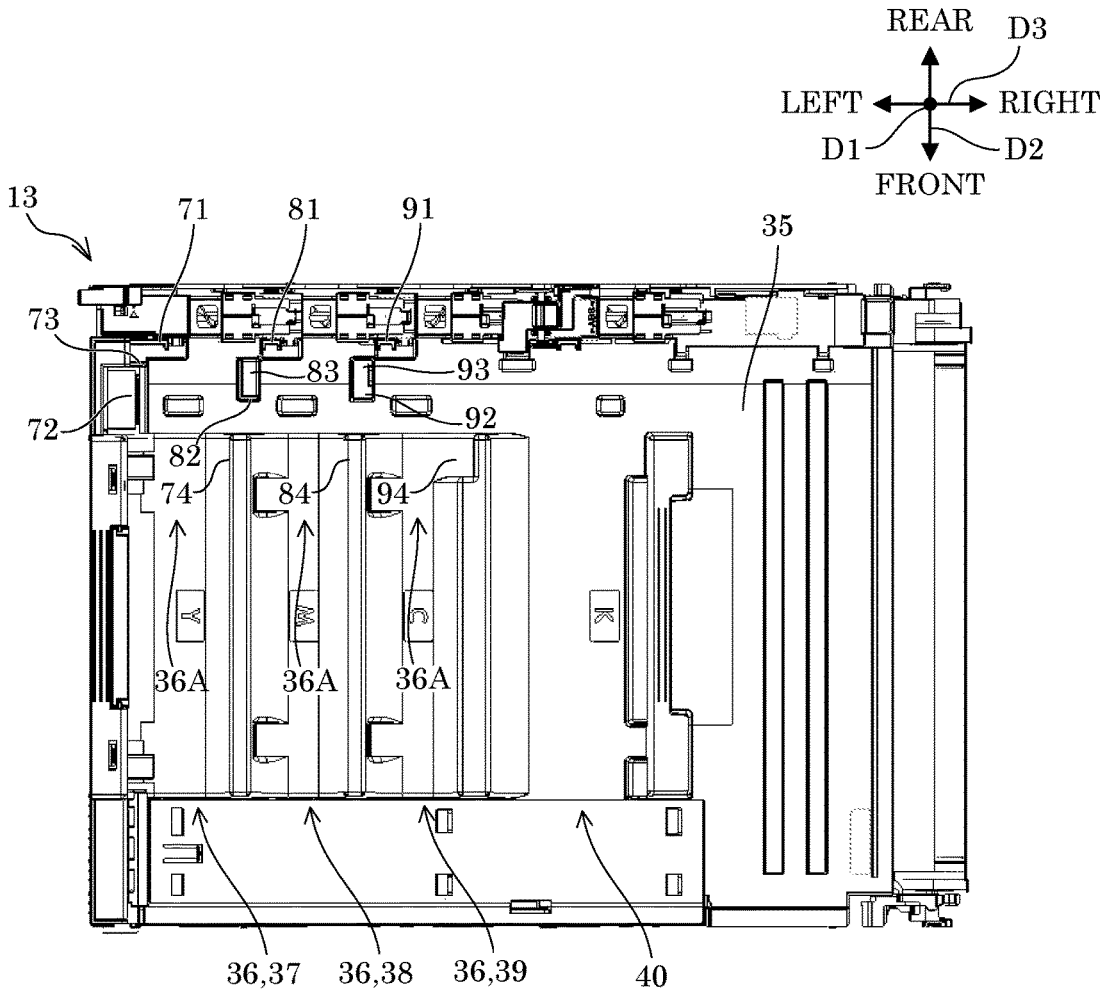
FIG. 12 is a diagram showing the configuration of the mounting portions of the image forming apparatus according to the embodiment of the present disclosure.
Figure 13:
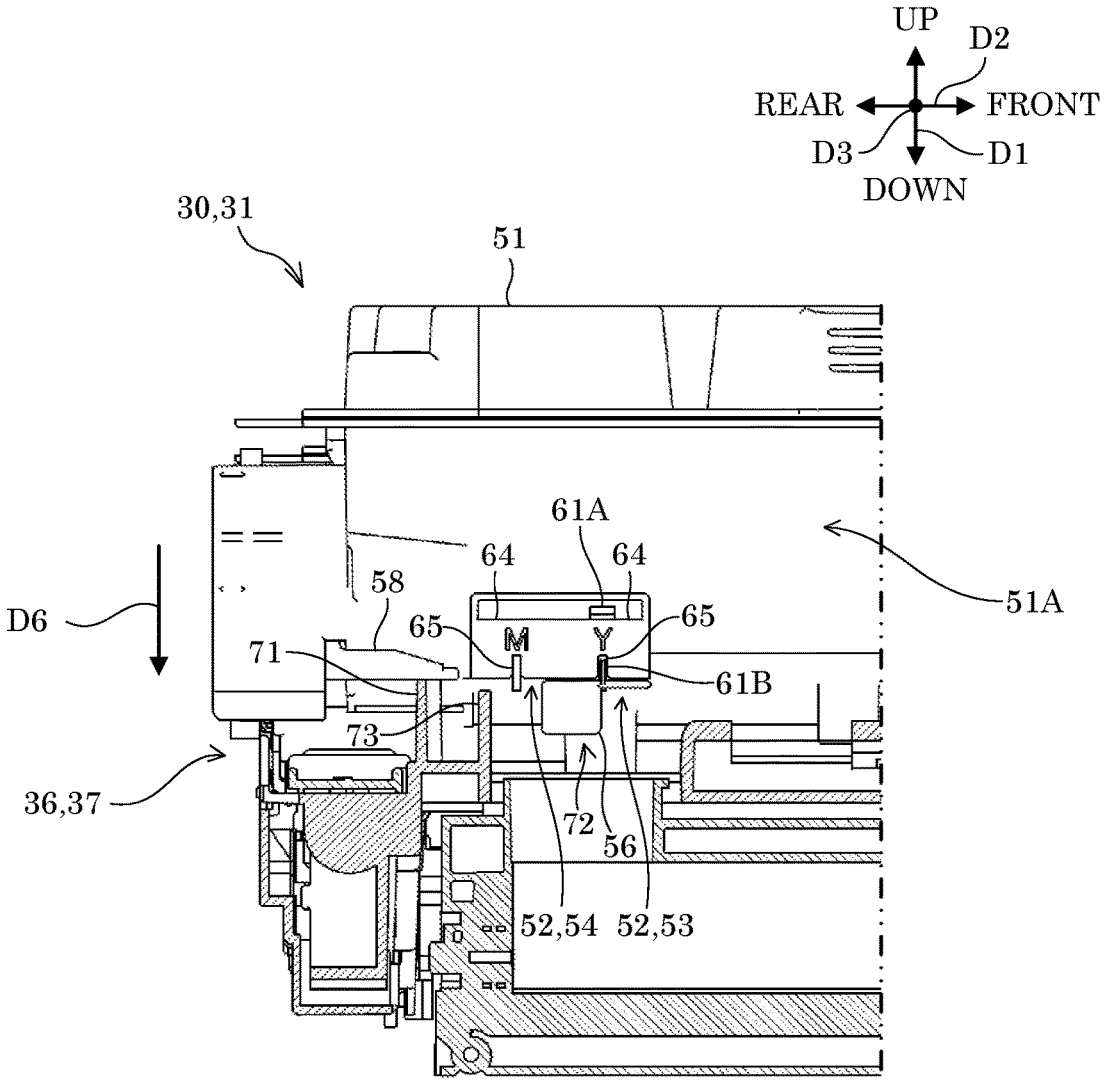
FIG. 13 is a diagram showing the toner container of the image forming apparatus according to the embodiment of the present disclosure, wherein the toner container is in an attached posture.
Figure 14:
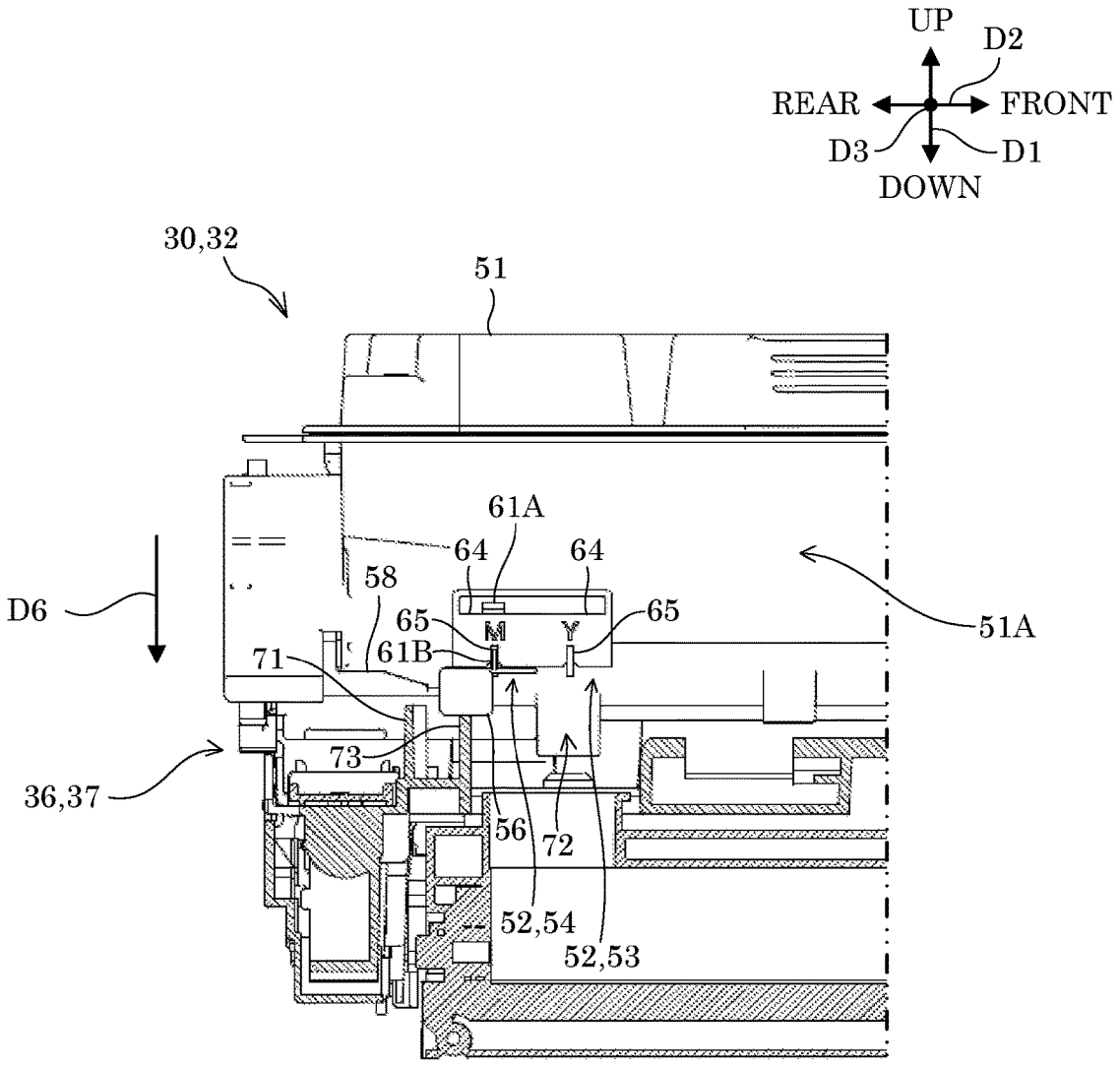
FIG. 14 is a diagram showing the toner container of the image forming apparatus according to the embodiment of the present disclosure, wherein the toner container is in a detached posture.

The configuration of the mounting portions 37-39 will be described below with reference to FIG. 10 to FIG. 14. FIG. 10 is a perspective view showing the configuration of a container supporting portion 35. FIG. 11 is a perspective view showing the container supporting portion 35 viewed from another viewpoint. FIG. 12 is a plan view showing the configuration of the container supporting portion 35. FIG. 13 is a diagram showing a state where the toner container 31 is attached to the mounting portion 37. FIG. 14 is a diagram showing a state (non-attached state) where the toner container 32 is not attached to the mounting portion 37 due to block by the contact between the contacting portion 73 and the shape forming member 56.

As shown in FIG. 10 to FIG. 12, the mounting portion 37 has an operating portion 71, an opposing portion 72, a contacting portion 73 and a contacting portion 74.

The operating portion 71 operates the lever member 58 of the toner container 30 during attachment of the toner container 30 to the mounting portion 37. Specifically, as shown in FIG. 10 and FIG. 11, the operating portion 71 projects from the bottom of the mounting portion 37 in a direction opposite the mounting direction D6. The operating portion 71 is provided to a position to oppose the to-be-contacted portion 58B of the lever member 58 during attachment of the toner container 30 to the mounting portion 37.

In an attachment process of the toner container 30 to the mounting portion 37, the operating portion 71 contacts the to-be-contacted portion 58B and thus the lever member 58 is pushed upward in a direction opposite the mounting direction D6 (see FIG. 13). This attachment process of the toner container 30 to the mounting portion 37 causes the shutter member 57 of the toner container 30 to change from a closed state to an open state. Hereinafter, the state where the shutter member 57 is in the open state changed from the closed state by the attachment operation of the toner container 30 to the mounting portion 36 by user is called an attached state of the toner container 30.

[The contacting portion 73 contacts the shape forming member 56 prior to formation of the attached state of the toner container 30 when the toner container 30 having the shape forming member 56 in the opening 54 (toner container 32) is to be attached to the mounting portion 37, avoiding the attachment of the toner container 30 to the mounting portion 37 (see FIG. 14). More specifically, as shown in FIG. 10 and FIG. 11, the contacting portion 73 projects from the bottom of the mounting portion 37 in a direction opposite the mounting direction D6. The contacting portion 73 is provided to a position opposing the opening 54 of the toner container 30 when the toner container 30 is to be attached to the mounting portion 37. The contacting portion 73 projects from the bottom of the mounting portion 37 (see FIG. 14). The contacting portion 73 has a length to contact the shape forming member 56 attached to the opening 54 prior to the contact between the operating portion 71 and the lever member 58.

The contacting portion 74 contacts the shape forming member 56 to block the attachment of the toner container 30 to the mounting portion 37 when the toner container 30 having the shape forming member 56 in the opening 55 (toner container 33) is to be attached to the mounting portion 37, avoiding the attached state of the toner container 30. Specifically, as shown in FIG. 10 and FIG. 11, the contacting portion 74 projects from the bottom of the mounting portion 37 in a direction opposite the mounting direction D6. The contacting portion 74 is provided to a position opposing the opening 55 of the toner container 30 when the toner container 30 is to be attached to the mounting portion 37. The contacting portion 74 has the same height as the contacting portion 73.

The opposing portion 72 faces against the shape forming member 56 of the toner container 30 attached to the mounting portion 37 when the toner container 30 having the shape forming member 56 in the opening 53 (toner container 31) is to be attached to the mounting portion 37 (see FIG. 13). Specifically, as shown in FIG. 10 and FIG. 11, the opposing portion 72 is shorter than the contacting portion 73 in height. The opposing portion 72 is provided to a position facing against the opening 53 of the toner container 30 when the toner container 30 is to be attached to the mounting portion 37. The opposing portion 72 is formed so as not to contact the shape forming member 56 attached to the opening 53 prior to the contact between the operating portion 71 and the lever member 58.

In the mounting portion 37, the opposing portion 72, the contacting portion 73 and the contacting portion 74 together form a second non-compatible shape 36A. In the mounting portion 37 having the second non-compatible shape 36A, a toner container 30 having a first non-compatible shape 30A that corresponds to the second non-compatible shape 36A can be attached, while a toner container 30 not having a first non-compatible shape 30A corresponding to the second non-compatible shape 36A cannot be attached.

As shown in FIG. 10 to FIG. 12, the mounting portion 38 has an operating portion 81, an contacting portion 82, a opposing portion 83 and a contacting portion 84.

The operating portion 81 operates a lever member 58 of the toner container 30 during attachment of the toner container 30 to the mounting portion 38. More specifically, as shown in FIG. 10 and FIG. 11, the operating portion 81 projects from the bottom of the mounting portion 38 in a direction opposite the mounting direction D6. The operating portion 81 is provided to a position to oppose the to-be-contacted portion 58B of the lever member 58 during attachment of the toner container 30 to the mounting portion 38. The operating portion 81 has the same height as the operating portion 71.

The contacting portion 82 contacts the shape forming member 56 prior to formation of the attached state of the toner container 30 when the toner container 30 having the shape forming member 56 in the opening 53 (toner container 31) is to be attached to the mounting portion 38, avoiding the attachment of the toner container 30 to the mounting portion 38. Specifically, as shown in FIG. 10 and FIG. 11, the contacting portion 82 projects from the bottom of the mounting portion 38 in a direction opposite the mounting direction D6. The contacting portion 82 is provided to a position opposing the opening 53 of the toner container 30 when the toner container 30 is to be attached to the mounting portion 38. The contacting portion 82 has the same height as the contacting portion 73.

The contacting portion 84 contacts the shape forming member 56 prior to formation of the attached state of the toner container 30 when the toner container 30 having the shape forming member 56 in the opening 55 (toner container 33) is to be attached to the mounting portion 38, avoiding the attachment of the toner container 30 to the mounting portion 38. Specifically, as shown in FIG. 10 and FIG. 11, the contacting portion 84 projects from the bottom of the mounting portion 38 in a direction opposite the mounting direction D6. The contacting portion 84 is provided to a position opposing the opening 55 of the toner container 30 when the toner container 30 is to be attached to the mounting portion 38. The contacting portion 84 has the same height as the contacting portion 73.

The opposing portion 83 faces against the shape forming member 56 of the toner container 30 attached to the mounting portion 38 when the toner container 30 having the shape forming member 56 in the opening 54 (toner container 32) is to be attached to the mounting portion 38. Specifically, as shown in FIG. 10 and FIG. 11, the opposing portion 83 is shorter than the contacting portion 73 in height. The opposing portion 83 is provided to a position facing against the opening 54 of the toner container 30 when the toner container 30 is to be attached to the mounting portion 38. The opposing portion 83 is formed so as not to contact the shape forming member 56 attached to the opening 54 prior to the contact between the operating portion 81 and the lever member 58.

In the mounting portion 38, the opposing portion 83, the contacting portion 82 and the contacting portion 84 together form a second non-compatible shape 36A. In the mounting portion 38 having the second non-compatible shape 36A, a toner container 30 having a first non-compatible shape 30A that corresponds to the second non-compatible shape 36A can be attached, while a toner container 30 not having a first non-compatible shape 30A corresponding to the second non-compatible shape 36A cannot be attached.

As shown in FIG. 10 to FIG. 12, the mounting portion 39 has an operating portion 91, an opposing portion 94, a contacting portion 93 and a contacting portion 92.

The operating portion 91 operates a lever member 58 of the toner container 30 during attachment of the toner container 30 to the mounting portion 39. Specifically, as shown in FIG. 10 and FIG. 11, the operating portion 91 projects from the bottom of the mounting portion 39 in a direction opposite the mounting direction D6. The operating portion 91 is provided to a position to oppose the to-be-contacted portion 58B of the lever member 58 during attachment of the toner container 30 to the mounting portion 39. The operating portion 91 has the same height as the operating portion 71.

The contacting portion 92 contacts the shape forming member 56 prior to formation of the attached state of the toner container 30 when the toner container 30 having the shape forming member 56 in the opening 53 (toner container 31) is to be attached to the mounting portion 39, avoiding the attachment of the toner container 30 to the mounting portion 39. Specifically, as shown in FIG. 10 and FIG. 11, the contacting portion 92 projects from the bottom of the mounting portion 39 in a direction opposite the mounting direction D6. The contacting portion 92 is provided to a position opposing the opening 53 of the toner container 30 when the toner container 30 is to be attached to the mounting portion 39. The contacting portion 92 has the same height as the contacting portion 73.

The contacting portion 93 contacts the shape forming member 56 prior to formation of the attached state of the toner container 30 when the toner container 30 having the shape forming member 56 in the opening 54 (toner container 32) is to be attached to the mounting portion 39, avoiding the attachment of the toner container 30 to the mounting portion 39. Specifically, as shown in FIG. 10 and FIG. 11, the contacting portion 93 projects from the bottom of the mounting portion 39 in a direction opposite the mounting direction D6. The contacting portion 93 is provided to a position opposing the opening 54 of the toner container 30 when the toner container 30 is to be attached to the mounting portion 39. The contacting portion 93 has the same height as the contacting portion 73.

The opposing portion 94 faces against the shape forming member 56 of the toner container 30 attached to the mounting portion 39 when the toner container 30 having the shape forming member 56 in the opening 55 (toner container 33) is to be attached to the mounting portion 39. Specifically, as shown in FIG. 10 and FIG. 11, the opposing portion 94 is shorter than the contacting portion 73 in height. The opposing portion 94 is provided to a position facing against the opening 55 of the toner container 30 when the toner container 30 is to be attached to the mounting portion 39. The opposing portion 94 is formed so as not to contact the shape forming member 56 attached to the opening 55 prior to the contact between the operating portion 91 and the lever member 58.

In the mounting portion 39, the opposing portion 94, the contacting portion 93 and the contacting portion 92 together form a second non-compatible shape 36A. In the mounting portion 39 having the second non-compatible shape 36A, a toner container 30 having a first non-compatible shape 30A that corresponds to the second non-compatible shape 36A can be attached, while a toner container 30 not having a first non-compatible shape 30A corresponding to the second non-compatible shape 36A cannot be attached.

As described above, in the image forming apparatus 100, attachment of the shape forming member 56 to the side wall portion 51A in a mode to correspond to one mounting portion 37 among of three mounting portions 37 forms a first non-compatible shape 30A that corresponds to the one mounting portion 37. Thus, two members, which are the container body 51 and the shape forming member 56, allow formation of three or more first non-compatible shapes 30A. This can reduce the number of molds to be used in production of toner containers 30, each having a non-compatible shape, for the apparatus including three or more mounting portions 37.

Figure 15:
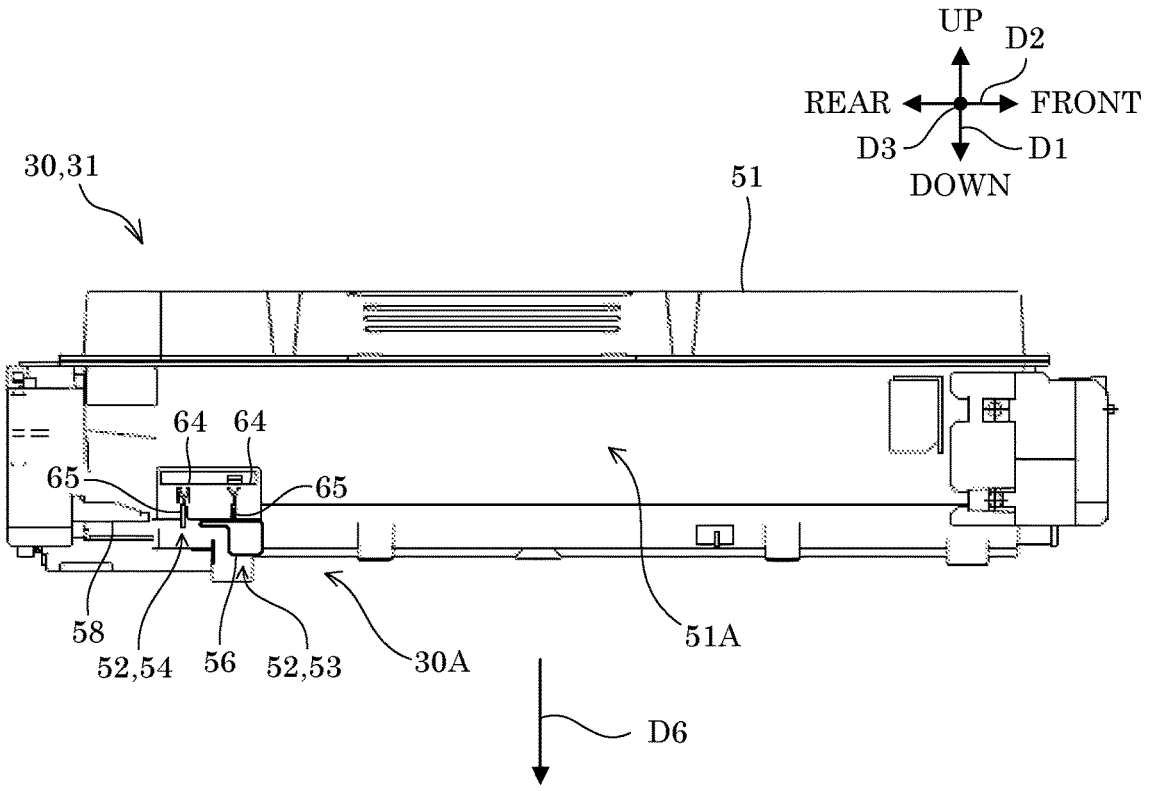
FIG. 15 is a diagram showing the configuration of the toner container of the image forming apparatus according to another embodiment of the present disclosure.

Note that the shape forming member 56 may form a first non-compatible shape 30A with the inserting portion 61 inserted into any one of the openings 52 in a first posture. The shape forming member 56 may form another first non-compatible shape 30A different from the former first non-compatible shape 30A with the same inserting portion 61 inserted into the same opening 52 in a second posture inverted from the first posture about an axis of the inserting direction D7. For example, if the inserting portion 61 of the shape forming member 56 shown in FIG. 5 is in the first posture, the inserting portion 61 inserted into the opening 53 with the second posture may form a first non-compatible portion 30A corresponding to the mounting portion 38 or mounting portion 39 as shown in FIG. 15. In this case, the opening 54 or opening 55 may not be provided.

The inserting portion 61 of the shape forming member 56 inserted into any one of the openings 52 with the first posture may form a first non-compatible shape 30A. This inserting portion 61 may be inserted into the same opening 52 with the second posture to form another first non-compatible shape 30A for another model of an image forming apparatus different from the image forming apparatus 100.

The controller 12 may restrain the operation of the image forming apparatus 100 in case where a shape forming member 56 forming a first non-compatible shape 30A corresponding to the mounting portion 36 mounted to the toner container 30 is not attached. For example, the controller 12 may prohibits execution of print processing. The controller 12 can determine attachment of the shape forming member 56 based on the ON/OFF state of a mechanical switch. The mechanical switch is mounted to the opposing portion 72 and is operated by the shape forming member 56 of a toner container 30 in response to the attachment of the toner container 30 to the mounting portion 37. The controller can determine the attachment of the shape forming member 56 using a reflective or transmissive optical sensor that can detect the shape forming member 56 facing against the opposing portion 72.

The developer in the present disclosure may be ink. Specifically, the present disclosure may be applied to an image forming apparatus of inkjet method, other than an image forming apparatus of electrophotographic method.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developer storage container to be attached to and detached from any one of three or more mounting portions provided to an image forming apparatus forming an image using a developer; the developer storage container comprising:

a container body including a side wall portion formed along a mounting direction to the image forming apparatus;

a shape forming member to be attached to the side wall portion with a mounting mode corresponding to any one of the three or more mounting portions to form a first non-compatible shape corresponding to the mounting portion; and openings, a number of the openings being the same as the mounting portions, the openings being disposed along a circumference direction of the side wall portion in the side wall portion, wherein the shape forming member includes an inserting portion, the inserting portion being inserted into any one of the openings so that part of the shape forming member excluding the inserting portion projects from the opening to thereby form the first non-compatible shape.

2. The developer storage container of claim 1, wherein the openings project from the side wall portion to outside the container body and open in the mounting direction.

3. The developer storage container of claim 1, wherein the shape forming member comprises:

a supporting portion supporting a rear end of the inserting portion in an inserting direction; and a projecting portion provided to the supporting portion at a distance from the inserting portion in a direction orthogonal to the inserting direction, the projecting portion projecting to an upstream side in the inserting direction.

4. An image forming apparatus comprising:

the developer storage container of claim 1; and the three or more mounting portions including respective second non-compatible shapes each having a different shape, wherein the first non-compatible shape has a shape corresponding to any one of the second non-compatible shapes.

5. The image forming apparatus of claim 4 further comprising a controller, the controller restraining an operation of the image forming apparatus when the developer storage container attached to the mounting portion does not have the shape forming member that forms the first non-compatible shape corresponding to the mounting portion.

6. A developer storage container to be attached to and detached from any one of three or more mounting portions provided to an image forming apparatus forming an image using a developer; the developer storage container comprising:

a container body including a side wall portion formed along a mounting direction to the image forming apparatus;

a shape forming member to be attached to the side wall portion with a mounting mode corresponding to any one of the three or more mounting portions to form a first non-compatible shape corresponding to the mounting portion; and a plurality of openings disposed along a circumference direction of the side wall portion in the side wall portion, wherein the shape forming member includes:

an inserting portion to be inserted into any one of the plurality of openings;

a supporting portion supporting a rear end of the inserting portion in an inserting direction; and a projecting portion provided to the supporting portion at a distance from the inserting portion in a direction orthogonal to the inserting direction, the projecting portion projecting to an upstream side in the inserting direction, the inserting portion inserted into any one of the openings in a first posture allows the shape forming member to form the first non-compatible shape, and the inserting portion inserted into a same opening of the openings in a second posture inverted from the first posture about an axis of the inserting direction allows the shape forming member to form another first non-compatible shape different from the former first non-compatible shape.

* * * * *